United States Patent [19]

Althouse et al.

[11] Patent Number: 4,641,907

[45] Date of Patent: Feb. 10, 1987

[54] PLATED FILTERED CONNECTOR

[75] Inventors: Rickie M. Althouse, Harrisburg; Robert E. Beamenderfer, Palmyra; Roger Durbin, Lancaster; Robert D. Hollyday, Elizabethtown; John P. Kling, Mt. Joy, all of Pa.

[73] Assignee: AMP Incorporated, Harrisburg, Pa.

[21] Appl. No.: 747,699

[22] Filed: Jun. 24, 1985

Related U.S. Application Data

[63] Continuation of Ser. No. 562,633, Dec. 19, 1983, abandoned.

[51] Int. Cl.[4] ..... H01R 13/658; H01R 13/66

[52] U.S. Cl. ..... 339/147 R; 333/182; 339/143 R

[58] Field of Search ..... 339/14 R, 143 R, 147 R; 333/182, 184, 185

[56] References Cited

U.S. PATENT DOCUMENTS

| | | | |
|---|---|---|---|
| 4,029,386 | 6/1977 | Krantz et al. | 339/143 R |
| 4,260,966 | 4/1981 | Boutros | 333/185 X |
| 4,276,523 | 6/1981 | Boutros et al. | 333/185 X |

*Primary Examiner*—Eugene F. Desmond

*Attorney, Agent, or Firm*—Katherine A. Nelson

[57] ABSTRACT

A solderless filtered connector is formed by a first housing of insulative material defining a plurality of filter passages, with resilient tines at least at one end of each passage. The first housing is plated with a conductive material to form a ground plane. Each filtered terminal is formed by a pin terminal having a compliant portion which engages an inner conductive surface of a respective filter sleeve, a filter locating shoulder and oppositely directed mating ends. Each filtered terminal is mounted in a respective passage with the tines making a resilient contact with the outer conductive surface of the filter. The connector can also include a second housing and front insert to enclose the filtered terminals and a metal shell for mating purposes.

16 Claims, 3 Drawing Figures

14
44
20
60
64
62
68
66
70
22
24
36
12
26
38
28
16
52
18
56
58
54
32
30
34

PLATED FILTERED CONNECTOR

This application is a continuation of application Ser. No. 562,633 filed Dec. 19, 1983, now abandoned.

The present invention concerns a filtered electrical connector and, in particular, a connector in which the filters are mounted in a completely solderless manner.

Filter sleeves, filtered terminals, and filtered connectors are well known. A typical coated ferrite RF filter sleeve is disclosed in U.S. Pat. No. 3,743,978 and U.S. Pat. No. Re. 29,258. The typical use of such filter sleeves is with a pin terminal passing through and soldered to the bore with the sleeve terminal assembly soldered by the outer sleeve surface into a hole in a metal ground plane. Examples of this type of use can be found in U.S. Pat. Nos. 3,961,294; 4,215,326 and 4,265,506. While this is the most common type of mounting, it causes a number of manufacturing problems. First, it is labor intensive and not readily adaptable to automation, second, the soldering operation can generate sufficient heat to destroy the filters, third, it is substantially impossible to test the filters and/or the connector until after complete assembly, and finally, it is quite difficult to repair such an assembly. In the case of repair, the malfuncioning filter must first be identified, the solder reheated to remove the bad filter and reheated a second time to insert the replacement. While this type of repair is possible, it requires a highly skilled operator in order to prevent damage to the surrounding filters during the reheating. Clearly this is both labor intensive and not readily adaptable to automation.

Attempts have been made to develop solderless ways in which to mount filter sleeves on pin terminals and in ground planes. These attempts have usually involved the use of inner and/or outer resilient members engaging the respective surfaces of the filter sleeve. Examples of this approach can be found in U.S. Pat. Nos. 3,753,168 and 3,961,295. The major drawback of these approaches has been the large number of parts that are involved and the care necessary for assembly. There is also the problem of the filter sleeves breaking from excessive spring and/or assembly forces.

The present invention overcomes the above discussed difficulties of the prior art by providing a totally solderless electrical connector.

The present invention is formed by a multi-part electrical connector having a first housing member formed in insulative material plated with conductive material and defining a plurality of filter passages opening into a forwardly directed cavity, a second housing member of insulative material defining a like plurality of conductor passages opening into a forwardly directed, first housing member receiving cavity, an insert member of insulative material having a like plurality of terminal passages and profiled to be received in the cavity of the first housing member, a metal shell secured to the first housing member, and a like plurality of filtered terminals each received in a respective passage. The filtered terminals are each formed by an elongated conductive terminal pin having a resilient intermediate section which engages the inner conductive surface of a respective filter sleeve, a shoulder adjacent the intermediate section for locating filter sleeves on the terminal pin, and oppositely directed mating ends. The outer conductive surface of each filter sleeve is engaged by the conductive plating on the first housing member, the plating forming a ground plane.

The present invention will now be described by way of example with reference to the accompanying drawings, in which.

Figure 1:
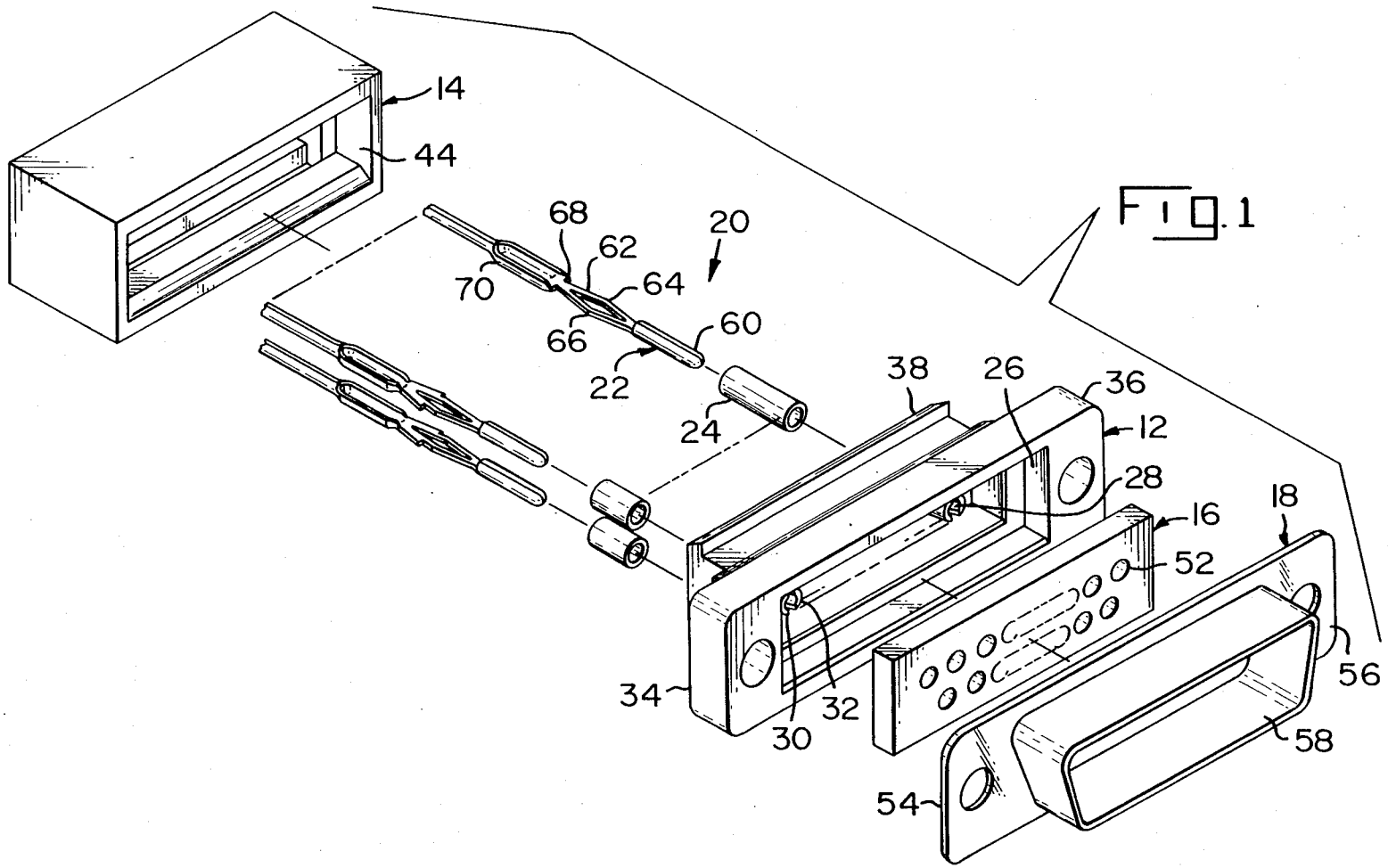
FIG. 1 is an exploded perspective view of an embodiment of the present invention.

The connector 10 is formed by a first housing 12, a second housing 14, an insert 16, a metal shell 18, and a plurality of filtered terminals 20, each formed by an assembly of a pin terminal 22 and a filter sleeve 24.

The first housing 12 is shown as an elongated member of rigid insulative material defining a forwardly directed cavity 26 with a plurality of filter passages 28 opening therein. Each passage 28 has at least two resilient tines 30, 32 forming an extension of the passage 28 in the cavity 26. The housing 12 also includes a pair of laterally directed mounting ears 34, 36 and a pair of outwardly directed mounting lugs 38, 40 adjacent to the rear of the housing. The entire first housing 12 is plated with a layer of conductive material 42.

The second housing 14 is also shown as an elongated member made of rigid insulative material defining a cavity 44 with a pair of inwardly directed elongated grooves 46, 48 spaced from the entrance of the cavity 44 and a plurality of conductor passages 50 entering the cavity from the rear of the housing, each passage 50 being aligned with a respective passage 28 of the first housing 12.

The insert member 16 is formed of insulative material and profiled to be received in the cavity 26 of the first housing 12. The insert member 16 includes a plurality of terminal passages 52 each aligned with a respective passage 28 of the first housing 12.

The shell 18 is a stamped and formed metal member having mounting ears 54, 56 and a forwardly directed integral shroud 58 which encloses and defines a mating face of the subject connector.

Each filtered terminal 20 comprises a terminal 22 and filter sleeeve 24. Each terminal 22 is an elongated member stamped and formed from metal stock to have a first mating end 60, an intermediate filter engaging portion 62 formed by a pair of outwardly bowed legs 64, 66 attached to each other at their end and forming a diamond shaped opening therebetween, an outwardly directed filter positioning shoulder 68, and a second mating end 70. It should be noted that while mating end 60 is shown as a pin, it could likewise be formed as a socket without departing from the invention. Likewise, the second mating end could be formed to mate with a further terminal or with a conductor by any of the well known solder, crimp, or insulation piercing configurations.

The filter sleeves 24 are preferably of the type disclosed in U.S. Pat. No. Re. 29,258, the disclosure of which is incorporated herein by reference.

Figure 2:
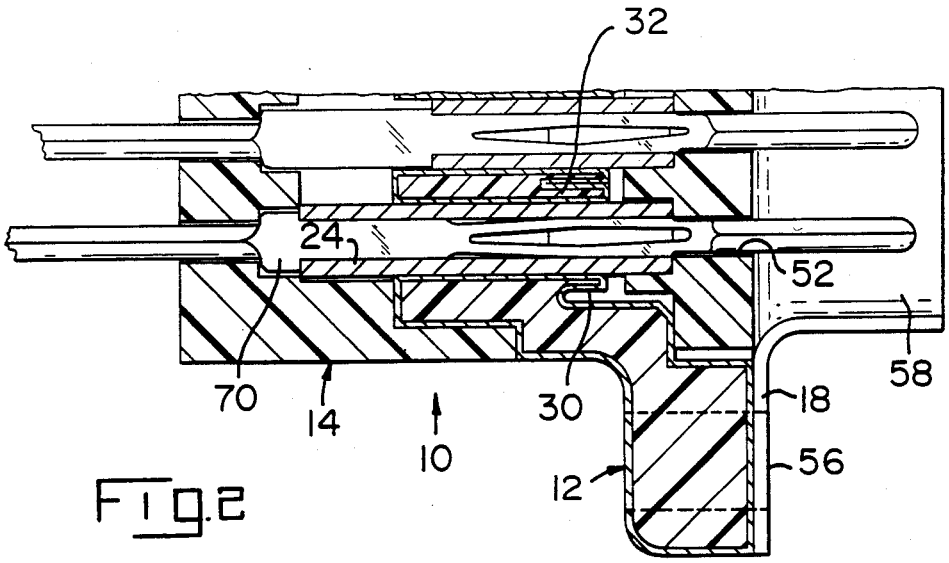
FIG. 2 is a horizontal section through one end of the connector of FIG. 1 in the assembled condition.
Figure 3:
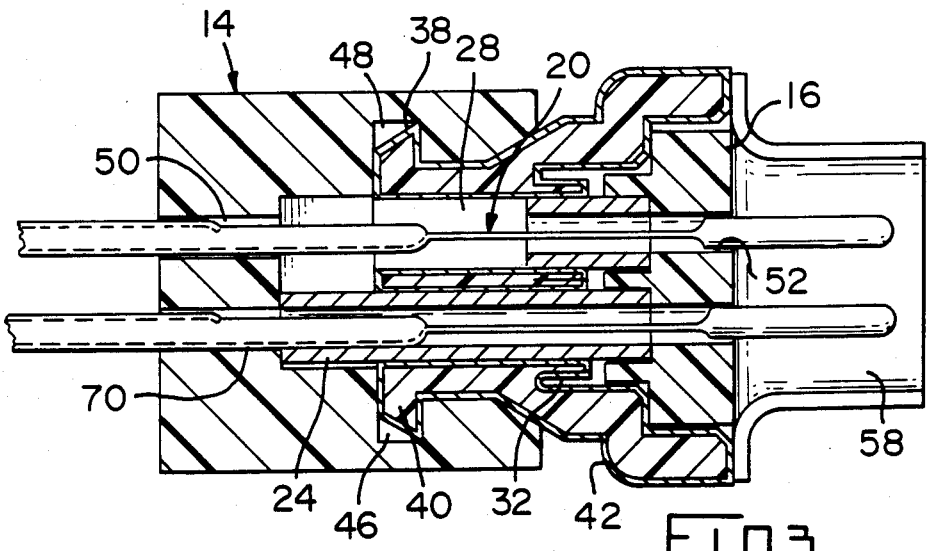
FIG. 3 is a transverse section through the subject connector.

The present invention is assembled by first placing the filter sleeves 24 on the respective terminals 22. Each filter 24 is slid over the terminal 22 until it abuts against the shoulder 68. In this position the legs 64, 66 are compressed, as shown in FIG. 2 and make a solid electrical and mechanical engagement against the inner conductive surface of the filter 24. The thus formed filter assemblies 20 are then inserted into the respective filter passages 28 of the front or first housing 12 pushing the tines 30, 32 outwardly to make a good resilient engagement between the plating 42 and the outer conductive surface of the respective filter sleeves 24. The insert 16 is placed over the mating portions 60 of the terminals 20 and forms both a mating face for the connector and a front support for the filters. Depending upon the configuration of the second mating end 70 of the terminals, either respective conductors, not shown, are terminated by the terminals or rear or second housing 14 is applied over the terminals and is snap fitted in place by engagement of the lugs 38, 40 in the respective grooves 46, 48. The shell 18 is secured to the front of the assembly and completes the circuit for the ground plane.

It will be appreciated from the foregoing that the present invention completely obviates the need for solder and it creates a connector in which the filtered terminals can be readily replaced by relatively unskilled labor in a both cost and time effective manner. The simplicity of structure and assembly makes this connector suitable for automated assembly.

We claim:

1. A solderless, filtered electrical connector comprising:

a first housing of insulative material defining a forwardly directed cavity and a plurality of passages opening into said cavity in a patterned array, each passage having at least two tines directed into said cavity forming an extension of the passage, conductive material plating the entire first housing, a second housing of rigid insulative material defining a cavity, at least a portion of said first housing being received in said cavity of said second housing, a like plurality of filtered terminals each comprising a tubular filter element having conductive outer and inner surfaces and an elongated terminal pin having a mating first end, a compliant filter receiving portion, filter locating shoulders, and a second oppositely directed second mating end, said filter element being mounted on said receiving portion with one end abutting said shoulders, said receiving portion engaging said inner conductive surface, each said filtered terminal being mounted in a respective passage with said tines engaging said outer conductive surface.

2. A solderless, filtered electrical connector according to claim 1 further comprising an insert member of insulative material having a plurality of bores therein in a like patterned array, said insert member being received in said cavity of said first housing with said terminals extending through respective bores, said insert member serving to support and protect said filter elements.

3. A solderless, filtered electrical connector according to claim 1 further comprising a metal member mounted on said first housing grounding said plating and having an opening defining a mating face for said connector.

4. A solderless, filtered electrical connector according to claim 3 further comprising an integral shroud about the periphery of said opening in said metal member.

5. A solderless, filtered electrical connector according to claim 1 further comprising means to latchingly engage said first housing in said second housing.

6. A solderless, filtered electrical connector according to claim 1 wherein said compliant filter receiving portion comprises a pair of outwardly bowed legs integral at each end and defining a diamond shaped opening therebetween.

7. A filtered electrical connector comprising an elongated first housing of insulative material defining a forwardly directed cavity and a plurality of passages in a patterned array extending therethrough to open on said cavity, at least two integral tines forming an extension of each passage in said cavity, said housing and tines being covered by conductive plating;

an insert of rigid insulative material profiled to be received in said cavity, a like plurality of bores each aligned with a respective passage;

a second housing of rigid insulative material defining a cavity profiled to receive at least a portion of said first housing therein;

a metal shell mounted on said first housing forming a ground path therefor; and a plurality of filtered terminals each comprising a tubular filter element having conductive coatings on outer and inner surfaces thereof and a pin terminal mounted through the bore of said element electrically and mechanically engaging said inner surface, each said filtered terminal being mounted in a respective one of said passages with said metalized tines engaging the outer surface thereof, said insert serving to enclose and support one end of said filtered terminal and said second housing enclosing the other end of said filtered terminal.

8. A solderless, filtered electrical connector, comprising:

dielectric housing means defining an external connector shell and having a series of passages extending therethrough, projection means as part of said housing means for each of the passages forming an extension of each of the passages, said housing means having conductive material plated thereon covering the entire housing means including said projection means;

filter element means positioned in respective passages, exterior surfaces of said filter element means electrically engaging the plated passages; and electrical terminal means disposed in respective passages and having a first mating end, a filter-engaging section and a second mating end, said filter-engaging section defining compliant means electrically and mechanically engaging inner surfaces of respective filter element means.

9. The solderless, filtered electrical connector according to claim 8 wherein said housing means is further comprised of a forwardly directed cavity, said passages opening into and said projection means extending into said cavity.

10. The solderless, filtered electrical connector according to claim 9 further comprising an insert member of insulative material having a plurality of bores therein, said insert member being received in said cavity of said housing means with one bore aligned with each said passage and having said terminals extending through respective bores, said insert member serving to support and protect said filter elements.

11. A solderless, filtered electrical connector according to claim 10 further comprising a metal member mounted on said housing means grounding said plating and having an opening defining a mating face for said connector.

12. A solderless, filtered electrical connector according to claim 11 further comprising an ingegral shroud about the periphery of said opening in said metal member.

13. A solderless, filtered electrical connector according to claim 8 further comprising a second housing means of rigid insulative material defining a cavity, at least a portion of said first housing means being received in said cavity of said second housing means.

14. A solderless, filtered electrical connector according to claim 13 further comprising means to latchingly engage said first housing in said second housing.

15. A solderless, filtered electrical connector according to claim 8 wherein said compliant filter receiving portion comprises a pair of outwardly bowed legs integral at each end and defining a diamond shaped opening therebetween.

16. A solderless, filtered electrical connector according to claim 8 wherein said projection means is comprised of at least two tines.

* * * * *